US007775057B2

(12) United States Patent
VanderZee

(10) Patent No.: US 7,775,057 B2
(45) Date of Patent: Aug. 17, 2010

(54) OPERATIONAL LIMIT TO AVOID LIQUID REFRIGERANT CARRYOVER

(75) Inventor: Joel C. VanderZee, La Crosse, WI (US)

(73) Assignee: Trane International Inc., Piscataway, NJ (US)

( * ) Notice: Subject to any disclaimer, the term of this patent is extended or adjusted under 35 U.S.C. 154(b) by 504 days.

(21) Appl. No.: 11/818,822

(22) Filed: Jun. 15, 2007

(65) Prior Publication Data

US 2008/0307810 A1 Dec. 18, 2008

(51) Int. Cl.
*F25B 1/00* (2006.01)

(52) U.S. Cl. ..... 62/222; 62/213; 62/225; 62/224; 62/228.1

(58) Field of Classification Search ..... 62/222, 62/209, 210, 228.1, 225, 224
See application file for complete search history.

(56) References Cited

U.S. PATENT DOCUMENTS 3,913,347 A * 10/1975 Stevens ..... 62/209
4,848,099 A * 7/1989 Beckey et al. ..... 62/212
5,035,119 A * 7/1991 Alsenz ..... 62/225
5,109,676 A * 5/1992 Waters et al. ..... 62/117
5,419,146 A 5/1995 Sibik et al.
5,632,154 A 5/1997 Sibik et al.
5,749,238 A * 5/1998 Schmidt ..... 62/211
5,778,695 A * 7/1998 Ring et al. ..... 62/218
5,829,264 A 11/1998 Ishigaki et al.
5,950,443 A * 9/1999 Meyer et al. ..... 62/228.5
6,003,325 A * 12/1999 Kurahashi et al. ..... 62/212
6,050,098 A * 4/2000 Meyer et al. ..... 62/213
6,276,152 B1 8/2001 Sibik
6,481,227 B1 * 11/2002 Ota et al. ..... 62/209
6,484,522 B2 * 11/2002 Tsuboi ..... 62/209
6,779,356 B2 8/2004 Lee et al.
6,854,285 B2 * 2/2005 Jessen ..... 62/225
6,938,429 B2 * 9/2005 Katogi et al. ..... 62/175
7,134,294 B2 * 11/2006 Singh et al. ..... 62/200
7,171,818 B2 * 2/2007 Oh et al. ..... 62/113
7,213,404 B2 * 5/2007 Chin et al. ..... 62/222
7,290,402 B1 * 11/2007 Bailey ..... 62/225
7,634,918 B2 * 12/2009 Kawaguchi et al. ..... 62/126
2003/0024256 A1 * 2/2003 Hanson ..... 62/208
2003/0070441 A1 * 4/2003 Moon et al. ..... 62/225
2004/0020223 A1 * 2/2004 Doi et al. ..... 62/225
2004/0206102 A1 * 10/2004 Homan et al. ..... 62/228.1
2005/0150240 A1 * 7/2005 Doi et al. ..... 62/225
2005/0257543 A1 * 11/2005 Martin et al. ..... 62/228.1
2006/0086117 A1 * 4/2006 Lee et al. ..... 62/228.1
2006/0162358 A1 * 7/2006 VanderZee ..... 62/225
2007/0144188 A1 * 6/2007 Kaga et al. ..... 62/157

* cited by examiner

*Primary Examiner*—George Nguyen
(74) *Attorney, Agent, or Firm*—William O'Driscoll

(57) ABSTRACT

A refrigerant system comprising a compressor, a condenser, an electronic expansion valve, and an evaporator is controlled in a normal operating mode to meet moderate cooling loads; however, when the load approaches that which is sufficient to induce liquid refrigerant carryover from the evaporator to the compressor, the system is controlled in a capped operating mode to limit a certain thermodynamic variable rather than controlled to meet the high load. In the normal mode, the compressor and/or the expansion valve might be controlled in response to the amount of superheat of the refrigerant leaving the evaporator or the level of liquid refrigerant in the evaporator. In the capped operating mode, the compressor and/or the expansion valve might be controlled to limit a variable such as the compressor's capacity, the saturated pressure or dynamic pressure of the refrigerant entering the compressor, or the refrigerant's mass flow rate.

17 Claims, 2 Drawing Sheets

OPERATIONAL LIMIT TO AVOID LIQUID REFRIGERANT CARRYOVER

BACKGROUND OF THE INVENTION

1. Field of the Invention

The subject invention generally pertains to refrigerant systems and more specifically to a system and method for avoiding carryover of liquid refrigerant from an evaporator to a compressor.

2. Description of Related Art

Refrigerant systems operating in a cooling mode typically include a compressor that forces refrigerant in series flow through a condenser for releasing heat from the refrigerant, a flow restriction (e.g., expansion valve) for cooling the refrigerant by expansion, and an evaporator where refrigerant therein vaporizes upon absorbing heat usually from a room being cooled or from some other cooling load. From the evaporator, the vaporized refrigerant returns to a suction side of the compressor to be recompressed and discharged back to the condenser to repeat the cycle.

If the refrigerant entering the compressor is not completely vaporized but instead has some entrained liquid refrigerant (known as "carryover"), one or more problems can result depending on the design of the refrigerant system. For some systems, high oil concentration in the evaporator promotes foaming and liquid carryover; the carryover introduces liquid refrigerant into the oil separator; liquid refrigerant in the oil separator reduces the separator's effectiveness; reduced separator effectiveness increases the oil concentration of the refrigerant; which in turn further increases the amount of oil in the evaporator; and that ultimately reduces the refrigerant system's efficiency and possible reduces the compressor's supply of oil.

For refrigerant systems that include a positive displacement compressor, such as a screw compressor, scroll compressor or a reciprocating compressor, carryover can damage the compressor, as liquid refrigerant is generally incompressible.

Although numerous liquid/gas separators have been developed to address the problem of carryover, such separators can add cost to the refrigerant system and can create an undesirable flow restriction between the evaporator and the compressor. Thus, there is a need for a better method of avoiding liquid carryover in a refrigerant system.

The present invention provides a method of controlling a refrigerant system to meet a cooling load that can vary from a range of lower loads to a higher load. The system includes a compressor that forces refrigerant in series through an expansion valve, an evaporator, and the compressor. The method includes the steps of: monitoring a thermodynamic variable associated with the refrigerant system; establishing a limit for the thermodynamic variable; comparing the thermodynamic variable to the limit to create a comparison; and, based on the comparison, selectively operating the refrigerant system in a normal operating mode and a capped operating mode. The method also includes the steps of: when operating the refrigerant system in the normal operating mode, controlling at least one of the compressor and the expansion valve so that the refrigerant system can address the cooling load within the range of lower loads; when operating the refrigerant system in the capped operating mode, controlling at least one of the compressor and the expansion valve in response to the thermodynamic variable so that the refrigerant system can at least partially address the cooling load at the higher load; and allowing the thermodynamic variable to vary more during the normal operating mode than during the capped operating mode.

The present invention also provides a method of controlling a refrigerant system to meet a cooling load that can vary from a range of lower loads to a higher load. The system includes a compressor that forces refrigerant in series through an expansion valve, an evaporator, and the compressor. The method includes the steps of: monitoring a primary thermodynamic variable associated with the refrigerant system; monitoring a secondary thermodynamic variable associated with the refrigerant system; establishing a limit for the secondary thermodynamic variable; comparing the secondary thermodynamic variable to the limit to create a comparison; based on the comparison, and selectively operating the refrigerant system in a normal operating mode and a capped operating mode. When operating the refrigerant system in the normal operating mode, the method includes the step of controlling at least one of the compressor and the expansion valve in response to the primary thermodynamic variable so that the refrigerant system can address the cooling load within the range of lower loads. When operating the refrigerant system in the capped operating mode, the method includes the step of controlling at least one of the compressor and the expansion valve in response to the secondary thermodynamic value so that the refrigerant system can at least partially address the cooling load at the higher load. The refrigerant system continues operating but does so at a restricted capacity that can help prevent the refrigerant from being carried over in a liquid state from the evaporator into the compressor when the refrigerant system is subject to the higher load.

The present invention further provides a system for controlling a refrigerant system. The system includes a cooling load that can vary from a range of lower loads to a higher load; a refrigeration system including a compressor that forces refrigerant in series through an expansion valve, an evaporator, and the compressor; apparatus for monitoring a thermodynamic variable associated with the refrigerant system; and apparatus for establishing a limit for the thermodynamic variable. The system also includes apparatus for comparing the thermodynamic variable to the limit to create a comparison; apparatus, based on the comparison, for selectively operating the refrigerant system in a normal operating mode and a capped operating mode; apparatus, when operating the refrigerant system in the normal operating mode, for controlling at least one of the compressor and the expansion valve so that the refrigerant system can address the cooling load within the range of lower loads; apparatus, when operating the refrigerant system in the capped operating mode, for controlling at least one of the compressor and the expansion valve in response to the thermodynamic variable so that the refrigerant system can at least partially address the cooling load at the higher load; and apparatus for allowing the thermodynamic variable to vary more during the normal operating mode than during the capped operating mode.

SUMMARY OF THE INVENTION

It is an object of the present invention to minimize carryover in a refrigerant system when the system is experiencing a particularly high cooling load.

Another object of some embodiments is to avoid carryover by limiting a refrigerant system's capacity to something less than what the system could otherwise achieve.

Another object of some embodiments is to avoid liquid refrigerant carryover by limiting a thermodynamic variable associated with the refrigerant system.

Another object of some embodiments is to avoid carryover by limiting the dynamic pressure of refrigerant entering the suction side of the compressor.

Another object of some embodiments is to determine the dynamic pressure of a refrigerant based at least partially on the volumetric displacement and speed of a positive displacement compressor.

Another object of some embodiments is to determine the dynamic pressure of a refrigerant based at least partially on the internal cross-sectional area of a conduit that conveys the refrigerant from the evaporator to the compressor.

Another object of some embodiments is to determine a maximum dynamic pressure of a refrigerant based at least partially on the saturated pressure of refrigerant flowing from the evaporator to the compressor.

Another object of some embodiments is to avoid carryover by limiting the mass flow rate of refrigerant entering the suction side of the compressor.

Another object of some embodiments is to determine the mass flow rate of a refrigerant based at least partially on a pressure drop across an expansion valve and the degree to which the valve is open.

Another object of some embodiments is to avoid carryover by limiting a refrigerant system's operating capacity.

Another object of some embodiments is to avoid carryover by limiting the saturated pressure of refrigerant flowing from the evaporator to the suction side of the compressor.

One or more of these and/or other objects of the invention are provided by a method of controlling a refrigerant system to avoid carryover by monitoring and limiting a thermodynamic variable of the system.

DESCRIPTION OF THE PREFERRED EMBODIMENT

Figure 1:
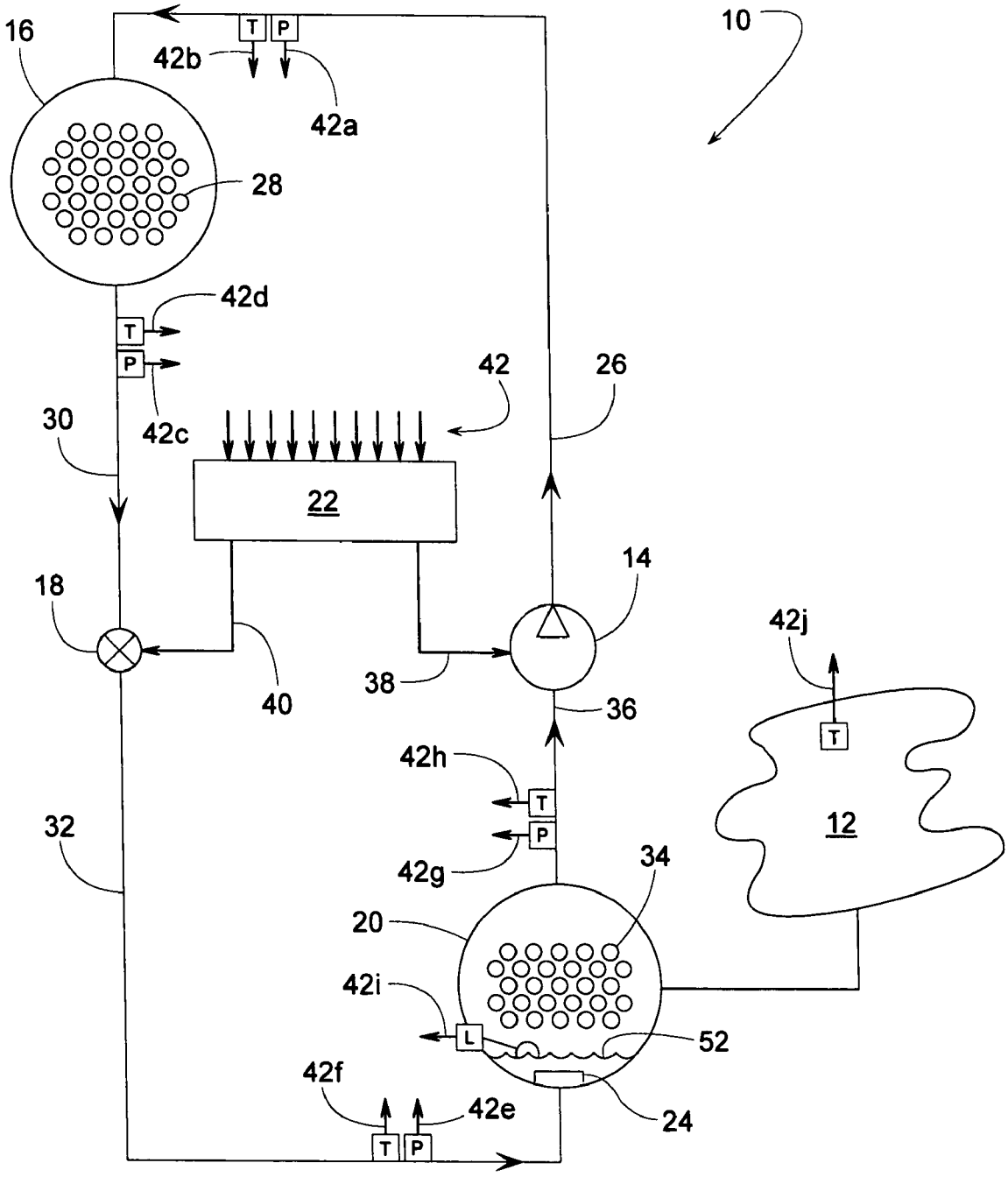
FIG. 1 is a schematic diagram of a refrigerant system.

Referring to FIG. 1, the present invention will be described with reference to a basic refrigerant system 10 that can be used for cooling a comfort zone 12 of a building or meeting some other cooling load. System 10 has at least four main components including, but not necessarily limited to, a compressor 14, a condenser 16, an expansion valve 18 and an evaporator 20.

System 10 also includes a microprocessor-based controller 22 that controls expansion valve 18 and/or compressor 14. Controller 22 is schematically illustrated to represent any microprocessor-based circuit that can execute an algorithm to provide one or more output signals in response to one or more feedback signals. Examples of controller 22 include, but are not limited to, a computer and a PLC (programmable logic controller).

It should be noted that system 10 serves as a basic model and that countless variations of system 10 are well within the scope of the invention. In some embodiments, for instance, system 10 may be reversible to selectively operate in a cooling or heating mode. System 10 might also include an economizer or other components whose structure and function are well known to those of ordinary skill in the art.

Although compressor 14 can be any type of compressor, the subject invention is particularly suited for positive displacement compressors such as screw, scroll and reciprocating compressors. Expansion valve 18 is preferably an electronically controlled valve, however, other types of expansion valves can be used. Evaporator 20 is shown having a two-phase refrigerant distributor 24, but other types of evaporators and distributors are certainly within the scope of the invention. Although evaporator 20 and condenser 16 are of a shell-and-tube design, other designs are possible including, but not limited to, air cooled condensers. The subject invention applies to systems using various refrigerants including, but not limited to, R123, R22, R134a, R410a and others.

The main components of system 10 are connected in series-flow relationship to create a conventional closed-loop refrigerant circuit. In basic operation, compressor 14 discharges compressed gaseous refrigerant through a discharge line 26 that leads to condenser 16. In this particular example, a cooling fluid passes through a tube bundle 28 to cool and condense the refrigerant in condenser 16.

A line 30 conveys the condensed refrigerant from condenser 16 through expansion valve 18. Upon passing through expansion valve 18, the refrigerant cools by expansion. A line 32 conveys the cooled refrigerant from expansion valve 18 to distributor 24 in evaporator 20. In this case, the refrigerant might enter distributor 24 and evaporator 20 as a two-phase mixture of liquid and gas.

Distributor 24 directs the mixture of liquid and gaseous refrigerant across a bundle of heat exchanger tubes 34. The refrigerant mixture flowing through evaporator 20 is generally a vaporous mist of gaseous refrigerant with entrained liquid refrigerant droplets. The liquid refrigerant droplets wet the exterior surface of tubes 34 and vaporize upon cooling a heat transfer fluid flowing therein. The heat transfer fluid in tubes 34, which can be water or some other fluid, can be pumped to comfort zone 12 or to other remote locations for various cooling purposes. Meanwhile, the vaporized refrigerant in evaporator 20 returns to a suction line 36 of compressor 14 to repeat the refrigerant cycle.

To control the operation of system 10, controller 22 provides outputs 38 and 40 that control compressor 14 and/or expansion valve 18 in response to one or more feedback signals 42. Feedback signals 42 might include one or more of the following: a pressure signal 42*a* representing the pressure of the refrigerant inside or entering condenser 16 (or leaving compressor 14), a temperature signal 42*b* representing the temperature of the refrigerant entering condenser 16 (or leaving compressor 14), a pressure signal 42*c* representing the pressure of the refrigerant inside or leaving condenser 16 (or entering expansion valve 18), a temperature signal 42*d* representing the temperature of the refrigerant leaving condenser 16 (or entering expansion valve 18), a pressure signal 42*e* representing the pressure of the refrigerant inside or entering evaporator 20 (or leaving expansion valve 18), a temperature signal 42*f* representing the temperature of the refrigerant entering evaporator 20 (or leaving expansion valve 18), a pressure signal 42*g* representing the pressure of the refrigerant inside or leaving evaporator 20 (or entering compressor 14), a temperature signal 42*h* representing the temperature of the refrigerant leaving evaporator 20 (or entering compressor 14), a liquid level signal 42*i* representing the level of liquid refrigerant in evaporator 20, and a temperature signal 42*j* representing a temperature associated with comfort zone 12 (or some other cooling load).

Controller 22 can use one or more of these feedback signals 42 in addition to other information to control system 10 such that system 10 can meet the cooling load of comfort zone 12 when the load is within a range of lower loads and can avoid carryover at a higher load. To do this, controller 22 can follow a predetermined algorithm such as those shown in FIGS. 2 and 3.

Figure 2:
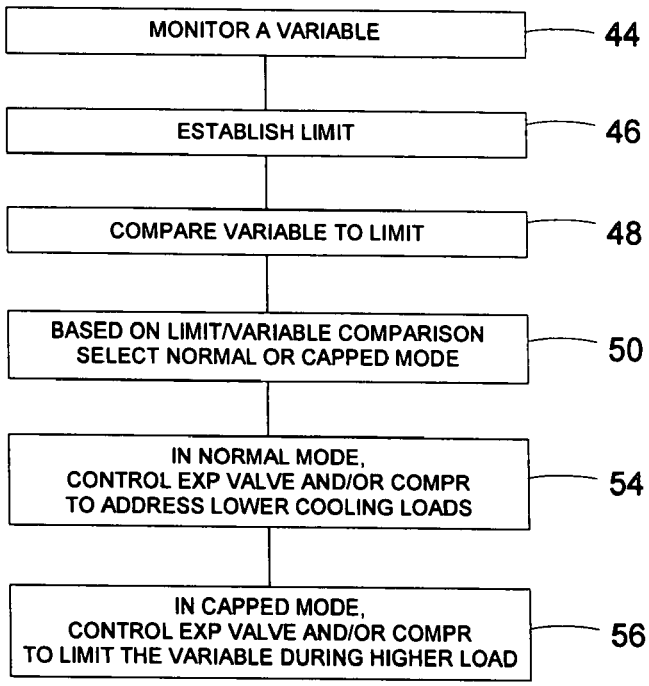
FIG. 2 is a flow chart illustrating a method of controlling the refrigerant system of FIG. 1.

In the algorithm of FIG. 2, a step 44 directs controller 22 to monitor a thermodynamic variable associated with system 10. The thermodynamic variable can be any changing value that helps determine whether system 10 operates is a normal operating mode or a capped operating mode. In the normal operating mode, system 10 is controlled to meet the cooling load (e.g., cooling demand of comfort zone 12). In the capped operating mode, system 10 is controlled to operate at a restricted capacity that minimizes or avoids liquid refrigerant carryover from evaporator 20 to compressor 14. Examples of the thermodynamic variable include, but are not limited to, mass flow rate of the refrigerant through expansion valve 18, dynamic pressure of the refrigerant flowing from evaporator 20 to compressor 14, and the static pressure of the refrigerant flowing from evaporator 20 to compressor 14.

A step 46 illustrates the step of establishing a limit for the thermodynamic value, and in step 48, controller 22 compares the value of the thermodynamic variable to that limit. In step 50, the resulting comparison determines whether controller 22 operates system 10 in the normal operating mode or the capped operating mode.

In the normal operating mode, the cooling load is generally within a range of lower loads, and controller 22 provides output signals 38 and/or 40 to control compressor 14 and/or expansion valve 18 such that system 10 can meet the lower cooling load. In the normal operating mode, system 10 can be controlled in any conventional manner familiar to those of ordinary skill in the art. Controller 22, for instance, could adjust the opening of expansion valve 18, the speed of compressor 14, and/or the pumping capacity of compressor 14 in response to feedback from one or more of signals 42 from which the value of the thermodynamic value can be determined directly or derived therefrom. In some cases, controller 22 might adjust the opening of expansion valve 18 in response to signals 42*g* and 42*h* to achieve a desired level of superheat of the refrigerant leaving evaporator 20. In other cases, controller 22 might adjust the opening of expansion valve 18 and the capacity of compressor 14 in response to signal 42*i* to maintain a predetermined level of liquid refrigerant 52 in evaporator 20.

In the capped operating mode, the cooling load of zone 12 is sufficiently high to create a potential carryover problem, so instead of trying to fully meet such a high cooling demand, controller 22 operates according to step 54 of FIG. 2 to limit the value of the monitored thermodynamic variable.

In some embodiments, for example, the monitored and thus limited thermodynamic value is the mass flow rate of the refrigerant flowing in series through compressor 14, condenser 16, expansion valve 18 and/or evaporator 20. In this case, system 10 operates in the normal operating mode (already described) when the mass flow rate is varying somewhere below a certain limited mass flow rate; however, controller 22 switches system 10 to the capped operating mode when the mass flow rate reaches that limit.

Upon switching to the capped operating mode, controller 22 adjusts compressor 14 and/or the opening of expansion valve 18 to ensure that the mass flow rate does not go appreciably beyond the set limit, as indicated by step 56. Thus, the mass flow rate remains generally constant in the capped operating mode. When the mass flow rate decreases below the limit, controller 22 switches the operation back to the normal operating mode.

The mass flow rate can be measured directly using a conventional flow meter, or the flow rate can be determined by various other means. The mass flow rate, for instance, might be determined based on the expansion valve's degree of opening (via output signal 40), the pressure drop across valve 18 (signal 42*c* minus signal 42*e*), and the given flow characteristics of valve 18. Other factors, such as the temperature, pressure, and density of the refrigerant might also be considered in determining the refrigerant's mass flow rate.

In some cases, for example, the mass flow rate might be calculated based on the static pressure of the refrigerant flowing from evaporator 20 to compressor 14 plus the known speed and volumetric displacement of compressor 14. Even though the amount of superheat of the refrigerant entering compressor 14 can make the actual mass flow rate less than the calculated value, the calculated value can still be used as a worst-case estimate. To calculate a more precise mass flow rate, the amount of superheat can be measured and factored into the mass flow calculation.

In an alternate embodiment, the monitored and thus limited thermodynamic value is the dynamic pressure of the refrigerant flowing from evaporator 20 to compressor 14, and preferably the dynamic pressure of the refrigerant entering compressor 14 via suction line 36. In this case, system 10 operates in the normal operating mode (already described) when the dynamic pressure is varying somewhere below a predetermined limited dynamic pressure; however, controller 22 switches system 10 to the capped operating mode when the dynamic pressure reaches that limit.

Upon switching to the capped operating mode, controller 22 preferably adjusts compressor 14 (and/or the opening of expansion valve 18) to ensure that the dynamic pressure does not go appreciably beyond the set limit. Thus, the dynamic pressure remains generally constant in the capped operating mode. When the dynamic pressure decreases appreciably below the limit, controller 22 switches the operation back to the normal operating mode.

The dynamic pressure can be measured using appropriate pressure sensors, or it can be determined by various other means. The dynamic pressure, for instance, might be calculated as a product of the actual or maximum density of the refrigerant entering compressor 14 and the refrigerant's squared velocity upon entering compressor 14. In some cases, the refrigerant's velocity can be calculated as a function of the known speed and volumetric displacement of compressor 14 divided by an internal cross-sectional area of suction line 36. The refrigerant's density can be determined based on the static pressure (signal 42*g*) of the refrigerant flowing from evaporator 20 to compressor 14.

In cases where the compressor's volumetric displacement is unknown or the refrigerant's velocity is otherwise difficult to determine, the dynamic pressure might be calculated as the refrigerant's mass flow rate squared divided by the refrigerant's density. In this case, the mass flow rate can be measured directly using a conventional flow meter, or the flow rate can be determined by various other means. The mass flow rate, for instance, might be determined based on the expansion valve's degree of opening (via output signal 40), the pressure drop across valve 18 (signal 42*c* minus signal 42*e*), and the given flow characteristics of valve 18. Again, the refrigerant's density can be determined based on the static pressure (signal 42*g*) of the refrigerant flowing from evaporator 20 to compressor 14.

In yet another embodiment, the monitored and thus limited thermodynamic value is the static pressure of the refrigerant flowing from evaporator 20 to compressor 14. In this case, system 10 operates in the normal operating mode (already described) when the pressure is varying somewhere below a certain limited pressure; however, controller 22 switches system 10 to the capped operating mode when the pressure reaches that limit. This allows controller 22 to effectively limit the compressor's operating capacity to an approximate maximum capacity that is a predetermined amount above the compressor manufacturer's rated capacity.

Upon switching to the capped operating mode, controller 22 might adjust compressor 14 so as to ensure that the static pressure (signal 42*g*) does not go appreciably beyond the set limit. Thus, the pressure remains generally constant in the capped operating mode. When the pressure decreases appreciably below the limit, controller 22 switches the operation back to the normal operating mode.

Using pressure as the monitored thermodynamic value allows controller 22 to effectively limit the compressor's operating capacity to an approximate maximum capacity that is a predetermined amount above the compressor manufacturer's factory rated capacity. Limiting the compressor's operating capacity might avoid carryover during high load conditions.

The concept of limiting compressor capacity by limiting the saturated pressure of the refrigerant flowing from evaporator 20 to compressor 14 is based on a few basic relationships. First, a refrigerant mass flow rate can be calculated as a function a given predetermined maximum compressor capacity (e.g., BTU/min) divided by an actual or maximum change in enthalpy as the refrigerant passes through evaporator 20 (e.g., maximum enthalpy-out minus minimum enthalpy-in with units being, e.g., in BTU/lbm). Second, the maximum enthalpy-out is a function of the saturated pressure of the refrigerant leaving evaporator 20, and the minimum enthalpy-in is a function of the saturated pressure of the refrigerant flowing from condenser 16 to evaporator 20. Third, the calculated maximum mass flow rate of refrigerant is also a function of the known speed and volumetric displacement of compressor 14 (e.g., cfm) times the actual or maximum density (e.g., lbm/cubic ft.) of the refrigerant entering compressor 14, wherein that density is a function of the saturated pressure of the refrigerant entering compressor 14. Thus, the saturated pressure can be the thermodynamic property that can be monitored and controlled to limit the compressor's capacity.

Figure 3:
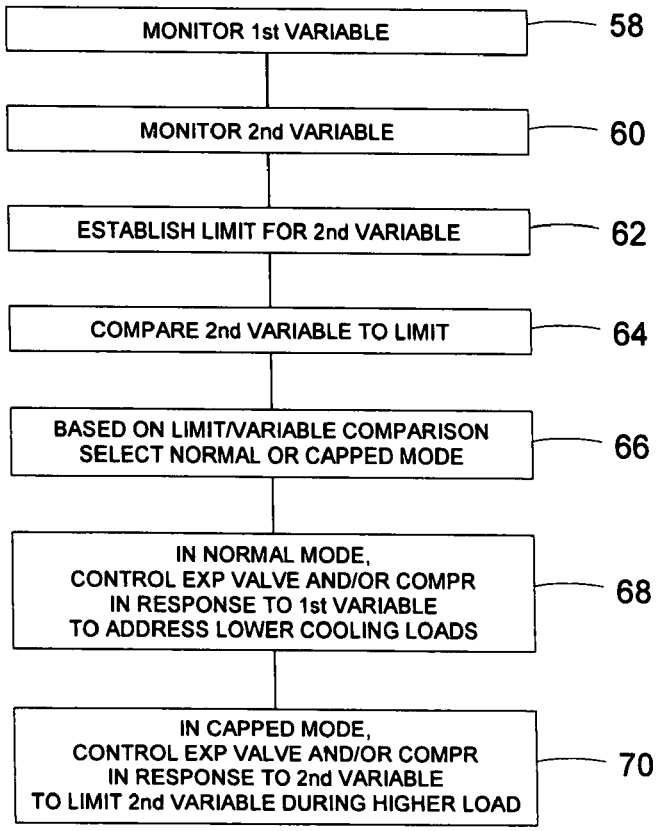
FIG. 3 is a flow chart illustrating another method of controlling the refrigerant system of FIG. 1.

For the method illustrated in FIG. 3, controller 22 controls system 10 in response to a primary thermodynamic variable (e.g., liquid level signal 42*i*) when system 10 is in the normal operation mode and controls system 10 in response to a secondary thermodynamic variable (e.g., pressure signal 42*g*) when system 10 is in the capped operating mode. In other cases, the primary thermodynamic variable could be the amount of superheat of the refrigerant leaving evaporator 20, and the secondary thermodynamic variable could be the refrigerant's mass flow rate, the static pressure of the refrigerant in evaporator 20, or the dynamic pressure of the refrigerant entering compressor 14.

In step 58 of FIG. 3, controller 22 monitors the primary thermodynamic variable. In step 60, controller 22 monitors the secondary thermodynamic variable. Step 62 establishes a limit for the secondary thermodynamic value, and in step 64, controller 22 compares the value of the secondary thermodynamic variable to that limit. In step 66, the resulting comparison determines whether controller 22 operates system 10 in the normal operating mode or the capped operating mode.

In the normal operating mode, indicated by step 68, the cooling load is generally within a range of lower loads, and controller 22 provides output signals 38 and/or 40 to control compressor 14 and/or expansion valve 18 in response to the monitored value of the primary thermodynamic variable such that system 10 can meet the lower cooling load. In the normal operating mode, system 10 can be controlled in any conventional manner familiar to those of ordinary skill in the art. Controller 22, for instance, could adjust the opening of expansion valve 18, the speed of compressor 14, and/or the pumping capacity of compressor 14 in response to feedback from one or more of signals 42 from which the value of the primary thermodynamic value can be determined directly or derived therefrom.

In the capped operating mode, the cooling load is sufficiently high to create a potential carryover problem, so instead of trying to fully meet such a high cooling demand in response to the primary thermodynamic variable, controller 22 operates according to step 70 of FIG. 3, wherein controller 22 provides output signals 38 and/or 40 to control compressor 14 and/or expansion valve 18 in response to the monitored value of the secondary thermodynamic variable such that system 10 can limit the value of the secondary thermodynamic variable.

Although the invention is described with respect to a preferred embodiment, modifications thereto will be apparent to those of ordinary skill in the art. The scope of the invention, therefore, is to be determined by reference to the following claims.

The invention claimed is:

1. A method of controlling a refrigerant system to meet a cooling load that can vary from a range of lower loads to a higher load, wherein the system includes a compressor that forces refrigerant in series through an expansion valve, an evaporator, and the compressor, the method comprising: monitoring a primary thermodynamic variable associated with the refrigerant system; monitoring a secondary thermodynamic variable associated with the refrigerant system; establishing a limit for the secondary thermodynamic variable; comparing the secondary thermodynamic variable to the limit to create a comparison; based on the comparison, selectively operating the refrigerant system in a normal operating mode and a capped operating mode; when operating the refrigerant system in the normal operating mode, controlling at least one of the compressor and the expansion valve in response to the primary thermodynamic variable so that the refrigerant system can address the cooling load within the range of tower loads; and when operating the refrigerant system in the capped operating mode, controlling at least one of the compressor and the expansion valve in response to the secondary thermodynamic value so that the refrigerant system can at least partially address the cooling load at the higher load, wherein the refrigerant system continues operating but does so at a restricted capacity that can help prevent the refrigerant from being carried over in a liquid state from the evaporator into the compressor when the refrigerant system is subject to the higher load.

2. The method of claim 1, wherein the primary thermodynamic variable is either a level of liquid refrigerant in the evaporator, or a level of superheat of the refrigerant flowing from the evaporator to the compressor.

3. The method of claim 2, wherein the secondary thermodynamic variable is substantially constant when the refrigerant system is in the capped operating mode.

4. The method of claim 2, wherein the secondary thermodynamic variable is a pressure of the refrigerant generally upstream of the compressor and downstream of the expansion valve.

5. The method of claim 4, wherein the pressure is a saturated pressure at a measured refrigerant temperature.

6. The method of claim 4, wherein the pressure is a dynamic pressure.

7. The method of claim 6, wherein the dynamic pressure is determined based at least partially on a volumetric displacement of the compressor and an operating speed of the compressor.

8. The method of claim 6, wherein the dynamic pressure is determined based at least partially on a volumetric displacement of the compressor, an operating speed of the compressor, and an internal cross-sectional area of a suction line that conveys the refrigerant from the evaporator to the compressor.

9. The method of claim 6, wherein the dynamic pressure is determined based at least partially on a volumetric displacement of the compressor, an operating speed of the compressor, and a density value of the refrigerant entering the compressor.

10. The method of claim 6, wherein the dynamic pressure is determined based at least partially on a mass flow rate of the refrigerant.

11. The method of claim 6, wherein the dynamic pressure is determined based at least partially on a mass flow rate of the refrigerant and an internal cross-sectional area of a suction line that conveys the refrigerant from the evaporator to the compressor.

12. The method of claim 6, wherein the dynamic pressure is determined based at least partially on a mass flow rate of the refrigerant and a density value of the refrigerant entering the compressor.

13. The method of claim 12, wherein the density value is at least partially based on a pressure of the refrigerant flowing from the evaporator to the compressor.

14. The method of claim 1, further comprising: monitoring a pressure drop across the expansion valve; monitoring an operating position of the expansion valve; and determining the mass flow rate based at least partially on the pressure drop and the operating position of the expansion valve.

15. The method of claim 1, wherein the secondary thermodynamic variable is a mass flow rate of refrigerant.

16. The method of claim 15, further comprising: monitoring a pressure drop across the expansion valve; monitoring an operating position of the expansion valve; and determining the mass flow rate based at least partially on the pressure drop and the operating position of the expansion valve.

17. The method of claim 1, wherein the secondary thermodynamic variable is a dynamic pressure of the refrigerant as the refrigerant flows from the evaporator into the compressor.

* * * * *

UNITED STATES PATENT AND TRADEMARK OFFICE

CERTIFICATE OF CORRECTION

PATENT NO. : 7,775,057 B2
APPLICATION NO. : 11/818822
DATED : August 17, 2010
INVENTOR(S) : Joel C. VanderZee It is certified that error appears in the above-identified patent and that said Letters Patent is hereby corrected as shown below:

Claim 1, Column 8, Line 43, delete "tower" and insert --lower--.

Signed and Sealed this

Seventh Day of December, 2010

David J. Kappos

David J. Kappos
*Director of the United States Patent and Trademark Office*